US005769729A

United States Patent [19]

D'Aguiar

[11] Patent Number: 5,769,729

[45] Date of Patent: Jun. 23, 1998

[54] POOL TABLE

[75] Inventor: David M. D'Aguiar, Cape Town, South Africa

[73] Assignee: League Pool Table Technology CC, Cape Town, South Africa

[21] Appl. No.: 876,339

[22] Filed: Jun. 16, 1997

[30] Foreign Application Priority Data

Jun. 20, 1996 [ZA] South Africa ..... 96/5228
Apr. 18, 1997 [ZA] South Africa ..... 97/3336

[51] Int. Cl.[6] ..... A63D 15/00

[52] U.S. Cl. ..... 473/24; 473/22

[58] Field of Search ..... 473/21, 22, 23, 473/24, 25, 27

[56] References Cited

U.S. PATENT DOCUMENTS

| | | | |
|---|---|---|---|
| 1,656,416 | 1/1928 | Brinkman | 473/22 |
| 3,658,328 | 4/1972 | Kooker | 473/22 |
| 3,877,702 | 4/1975 | Saliger | 473/22 |

*Primary Examiner*—Theatrice Brown
*Attorney, Agent, or Firm*—Darby & Darby

[57] ABSTRACT

A coin operated pool table is provided with ball collection channels formed in a sheet of material substantially co-extensive with and supported in the base below the table top such that the sheet prevents escape of the balls and protects the table top components housed in the base.

5 Claims, 1 Drawing Sheet

POOL TABLE

FIELD OF THE INVENTION

This invention relates to pool tables and more particularly to what are popularly known as "coin operated" pool tables.

BACKGROUND OF THE INVENTION

Coin operated pool tables are well known and require that each ball that has been played into a pocket of the table be retracted from play and collected. The collected balls are then fed to a holding zone until the coin operated release mechanism is actuated and balls are once again available for a new game to be played.

The collection means used in coin operated pool tables known to the applicant consists of a series of open topped interconnected channels leading one from each pocket to an approximately central gathering trough. A further channel leads from the trough to the holding zone at a side of the table. The channels are downwardly inclined so that the balls will roll to the holding zone under gravity.

It can happen and particularly where the pool table is subject to rough handling that a ball can be dislodged from a channel as it rolls towards the holding zone. In this event the table must be dismantled in order for the ball to be recovered for use or alternatively the ball must be replaced. Both operations are inconvenient and undesirable.

OBJECT OF THE INVENTION

It is the object of the present invention to provide ball collection means for coin operated pool tables wherein balls cannot be prevented from running in their collection channels for immediate return to the holding zone.

SUMMARY OF THE INVENTION

According to this invention there is provided a coin operated pool table including ball collection means comprising ball collecting channels extending from sheet material substantially co-extensive with and positioned below the table playing surface.

Further features of this invention provide for the sheet material to be suitable plastics material with collection channels formed therein, for the channels to be integral with the sheet and for the sheet to be secured to the table top supporting structure.

The invention also provides for the sheet to be of opaque material.

BRIEF DESCRIPTION OF THE DRAWINGS

These and other features of this invention will become apparent from the following description of a preferred embodiment illustrated in the accompanying drawings in which.

DETAILED DESCRIPTION WITH REFERENCE TO THE DRAWINGS

Figure 1:
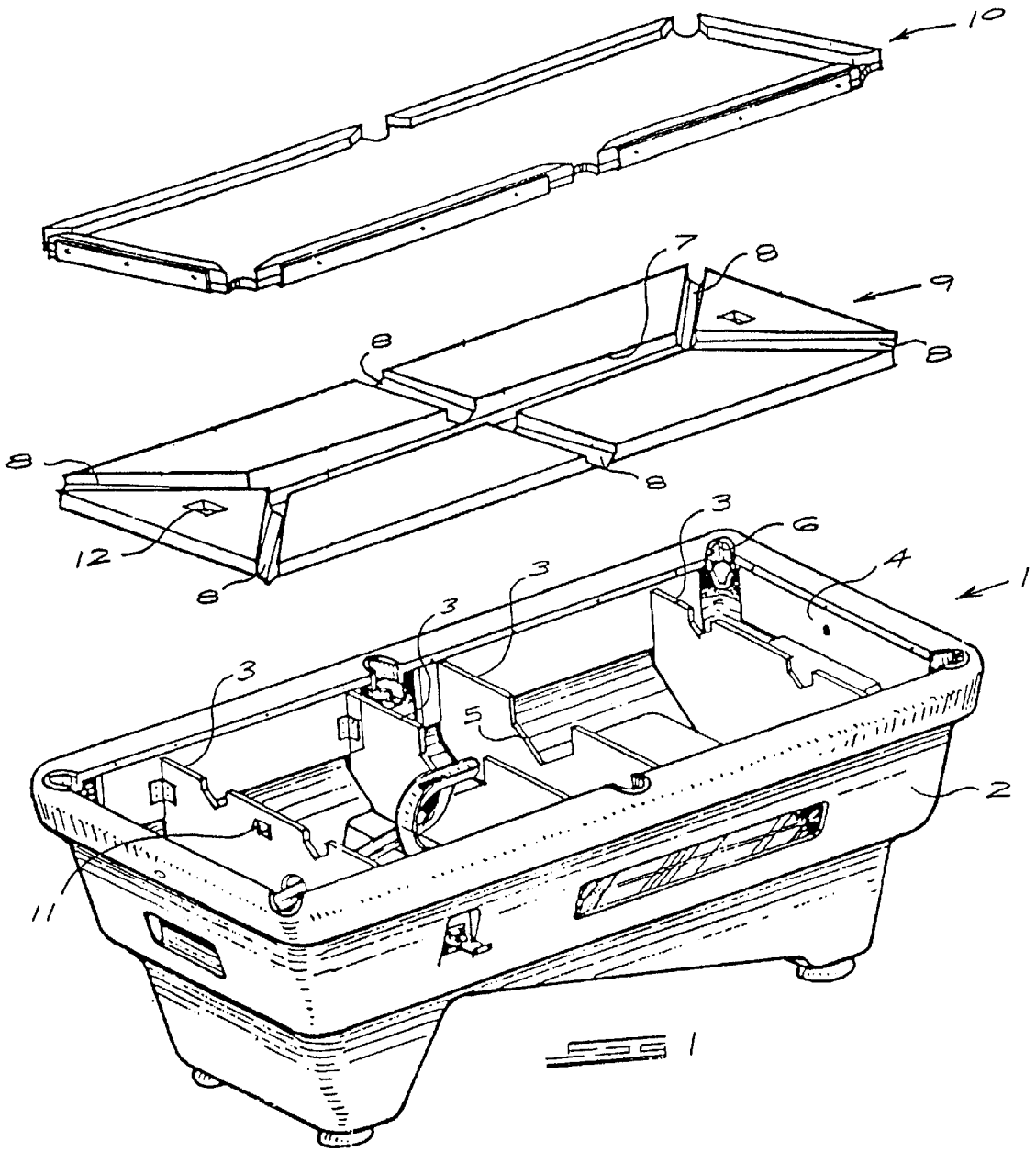
FIG. 1 is an exploded view of a table.
Figure 2:
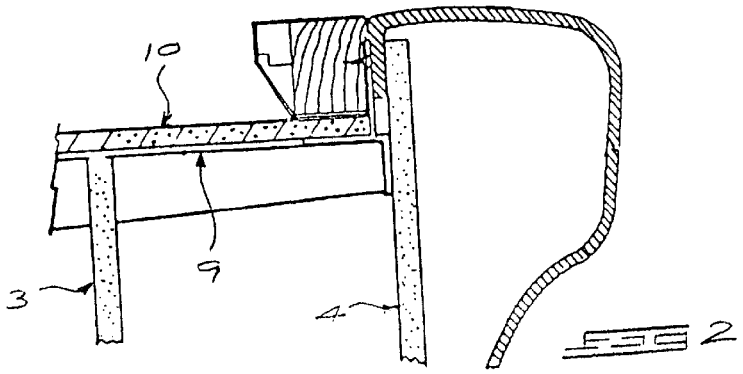
FIG. 2 shows a detail of the sheet mounting.

As illustrated a pool table (1) has a base (2) moulded as a single hollow unit housing coin operated ball release mechanism and table top supporting boards (3). Stabilising peripheral boards (4) are also provided.

The supporting boards (3) are cut away at (5) to accommodate ball collection channels which extend from each pocket (6) to a central collection trough (7).

The collection channels (8) are provided integral with a sheet (9) of suitable plastics material. The channels may be formed in the sheet in any convenient manner such as vacuum forming, injection moulding, pressing or the like.

The sheet (9) is made substantially co-extensive with the table top (10) and is fixed to the supporting and stabilising boards (3) and (4) with fixing screws. The table top is fitted on top of the sheet (9) and may be removed from the base (2) without interfering with the ball collection assembly formed in the sheet (9).

Supporting boards (3) at the ends of the table each have a wooden block (11) fixed to the side closest to the end of the table. A metal staple is attached to extend vertically from this wooden block (11).

The sheet (9) contains a recess (12) adjacent each end with a slot through its base. The vertical metal staples fixed to the wooden blocks (11) on the supporting boards (3), protrude through these slots when the plastic sheet (9) is fitted onto the supporting boards (3) and stabilising boards (4) inside the pool table (1).

A padlock can now be engaged around the metal staple and it will not protrude from the sheet but will be neatly tucked away inside the recess (12).

This locking system safeguards the components and money collection box housed with the base below the sheet (9). This way, the only component which can be manually removed from the completed table, without a key, is the table top and attached cushions (1).

The sheet (9) is made of opaque material so that the mechanisms below it in the table are also not visible when the top is removed for any purpose. This gives added security to the mechanisms.

In use the channels (8) operate in conventional manner but with the added advantage that balls cannot be dislodged therefrom and fall to the bottom of the table. The table top rests close to the upper edges of the channels and prevent the balls from escaping out of a channel. If it is desirable for any reason that the sheet be fitted some distance below the table top sufficient to enable a ball to escape from a channel it will immediately run off the sheet back into a collection channel and thence into the collection trough (7).

What I/We claim as new and desire to secure by Letters Patent is:

1. A coin operated pool table having a hollow moulded base supporting a top providing a playing surface and including ball collection means comprising ball collecting channels extending from sheet material substantially co-extensive with and positioned below the table playing surface.

2. A coin operated pool table as claimed in claim 1 in which the collection channels are formed integral with the sheet.

3. A coin operated pool table as claimed in claim 2 in which the sheet is formed from suitable plastics material.

4. A coin operated pool table as claimed in claim 3 in which the sheet is secured to table top supporting structure in the base and locked in position.

5. A coin operated pool table as claimed in claim 3 in which the sheet material is opaque.

* * * * *